US005105699A

United States Patent [19]

Dickson

[11] Patent Number: 5,105,699

[45] Date of Patent: Apr. 21, 1992

[54] SLICING ORIFICE

[76] Inventor: James Dickson, 3328 Tiffany La., Modesto, Calif. 95350

[21] Appl. No.: 567,593

[22] Filed: Aug. 15, 1990

[51] Int. Cl.[5] ..... B26D 7/02; B26D 3/16

[52] U.S. Cl. ..... 83/282; 83/375; 83/456; 83/465

[58] Field of Search ..... 83/32, 42, 282, 375, 83/379, 385, 386, 444, 452, 456, 461, 465

[56] References Cited

U.S. PATENT DOCUMENTS

| | | | |
|---|---|---|---|
| 1,144,120 | 6/1915 | Gladwin | 83/465 |
| 1,305,108 | 5/1919 | Holderman | 83/465 |
| 2,311,147 | 2/1943 | Williamson | 83/461 |
| 3,590,677 | 7/1971 | Smith | 83/694 |
| 4,428,263 | 1/1984 | Lindec et al. | 83/444 |
| 4,494,428 | 1/1985 | Malof | 83/465 |

*Primary Examiner*—Frank T. Yost
*Assistant Examiner*—Scott A. Smith
*Attorney, Agent, or Firm*—James E. Eakin

[57] ABSTRACT

The invention is a slicing orifice for use with a foodstuff slicing machine wherein the foodstuffs have been formed into loaves and the slicing machine includes a tray with a bed, a feed guide, a loaf indexing drive, a cutting head, an upper and lower clamping portion, a plurality of semicircular orifices in the clamping portions and being laterally offset from one another, wherein each orifice has a plurality of longitudinal gripping channels to effectively retain the foodstuffs during cutting.

1 Claim, 6 Drawing Sheets

SLICING ORIFICE

FIELD OF THE INVENTION

This application relates to foodstuff slicing machines generally, and in particular relates to feed trays used on foodstuff slicing machines for slicing foodstuffs preformed into loaves, bats or sticks.

BACKGROUND OF THE INVENTION

Slicing machines for slicing foodstuffs such as meat, salami and the like are well known and have existed for many years. Many of the foodstuffs processed by such slicing machines are first formed into loaves, bats or sticks, which typically have round or rectangular cross-sections. Although the terms "loaves", "bats" and "sticks" all are commonly used, the terms "loaf" or "loaves" will be used herein to include all three. Depending on the product involved, the loaves are consistently formed with a uniform cross-section; for example, one common size is a cylindrical loaf having a forty-five millimeter diameter. For best yield, the ends are squared off, although it is known to slice loaves having either tapered or squared off ends.

One well known slicing machine for slicing such loaves is the model numbers 2100 and 2600 slicing machines manufactured by Toby Enterprises, the relevant portion of which is shown in FIG. 1. Other manufacturers of slicing machines are Great Lakes, Grote, Thurne and Berlkel. FIG. 1 illustrates the feed tray of a Toby slicer together with the blade. In use, the product to be sliced 1 is placed on a bed 15 of the feed tray indicated generally at 10. The loaves are maintained in position on the feed tray by holding clamps, or fingers 20, in the Toby slicer and moved through the slicing head by means of one of a plurality of upper chains 30. The fingers 20 are maintained in tension against the loaves by a spring 40 mounted on a shaft 41. The loaves are guided along the bed 15 by a plurality of feed tray guides 50. In normal operation the loaves are moved in an indexed, stepped movement, where the size of step is preset according to the desired thickness of a slice.

Although not obvious from FIG. 1, the slicer feed tray is typically angled downward toward the blade so that gravity aids in directing the loaves to the slicer blade.

A significant difficulty encountered with this prior art clamping arrangement is that a significant amount of waste results because these prior art clamps doe not permit the ends of the loaves to be sliced. The waste which results from such slicing techniques is well known, but until now has been accepted as a necessary element of using a Toby slicer.

Additionally, while the Toby slicer can process single or multiple loaves, substantially greater waste results when multiple loaves are processed simultaneously.

There has therefore been a need for a clamping mechanism which reduces the amount of wastage at the ends of the loaves. There has also been a need for a clamping mechanism which permits multiple, vertical loaves to be sliced at a time without substantial additional wastage.

SUMMARY OF THE INVENTION

The present invention substantially improves upon the prior art by providing a slicing orifice which provides clamping capabilities that substantially reduce wastage of the ends of the loaves of foodstuffs being sliced, while at the same time permitting multiple loaves to be stacked vertically and sliced simultaneously.

The slicer orifice of the present invention comprises a rigid frame mounted to the conventional slicer, such as a model 2100 or model 2600 Toby slicer, a rigid subframe, an insert retained within the rigid subframe, and an actuation assembly for applying appropriate pressure to the loaf to be sliced to maintain the position of the loaf without damaging its integrity. The insert may be manufactured from plastic, such as Delrin, or other suitable materials.

The insert comprises an upper half and a lower half. The lower half is stationary, while the upper half is movable by the actuation assembly to apply pressure to the loaves as they are being fed through the slicer. The orifice of the present invention may be configured to precisely replace the existing clamping mechanism of the feed tray to a conventional Toby slicer, including removal of the finger assembly as well as the shear bar.

In operation, the loaf of foodstuff to be sliced is fed into the orifice and securely clamped into position for slicing. The leading edge of the loaf is indexed forwardly an by the appropriate slicing thickness, the slice is taken off the load, and the loaf is again indexed forward without, in at least most instances, removing the pressure on the orifice. The next slice is removed from the loaf, and the process repeats until the loaf is completely sliced.

Unlike conventional slicers, however, near the end of the loaf the clamping of the present orifice is sufficiently positive on even short portions of a loaf that the loaf can be sliced much closer to the end than in conventional designs, thus substantially reducing the amount of waste associated with conventional slicing machines.

In addition, the positive clamping pressure provided by the present invention is sufficiently controllable that more than one loaf can be stacked vertically and processed simultaneously, making it possible to slice multiple loaves at once.

It is therefore one object of the present invention to provide an improved slicing orifice for foodstuff slicing machines.

It is another object of the present invention to provide a slicing orifice which provides positive control of a loaf of foodstuff to permit the loaf to be sliced accurately very near the end of the loaf.

It is still another object of the present invention to provide a slicing orifice which will permit a plurality of loaves of foodstuff to be stacked and processed simultaneously without significantly increasing waste.

These and other objects of the present invention will be better appreciated from the following detailed description of the invention, taken together with the appended Figures.

THE FIGURES

FIG. 1*a* is a conventional slicing machine such as is well known in the prior FIG. 1*b* is a conventional feed tray for a slicing machine as is shown in FIG. 1*a*, and is well known in the prior art.

FIG. 2*a* is a perspective view of a slicing orifice for the feed tray of a slicing machine in accordance with the present invention.

FIG. 2*b* is a perspective view of a slicing orifice in accordance with the present invention, viewed from the blade side.

DETAILED DESCRIPTION OF THE INVENTION

Figure 1A:
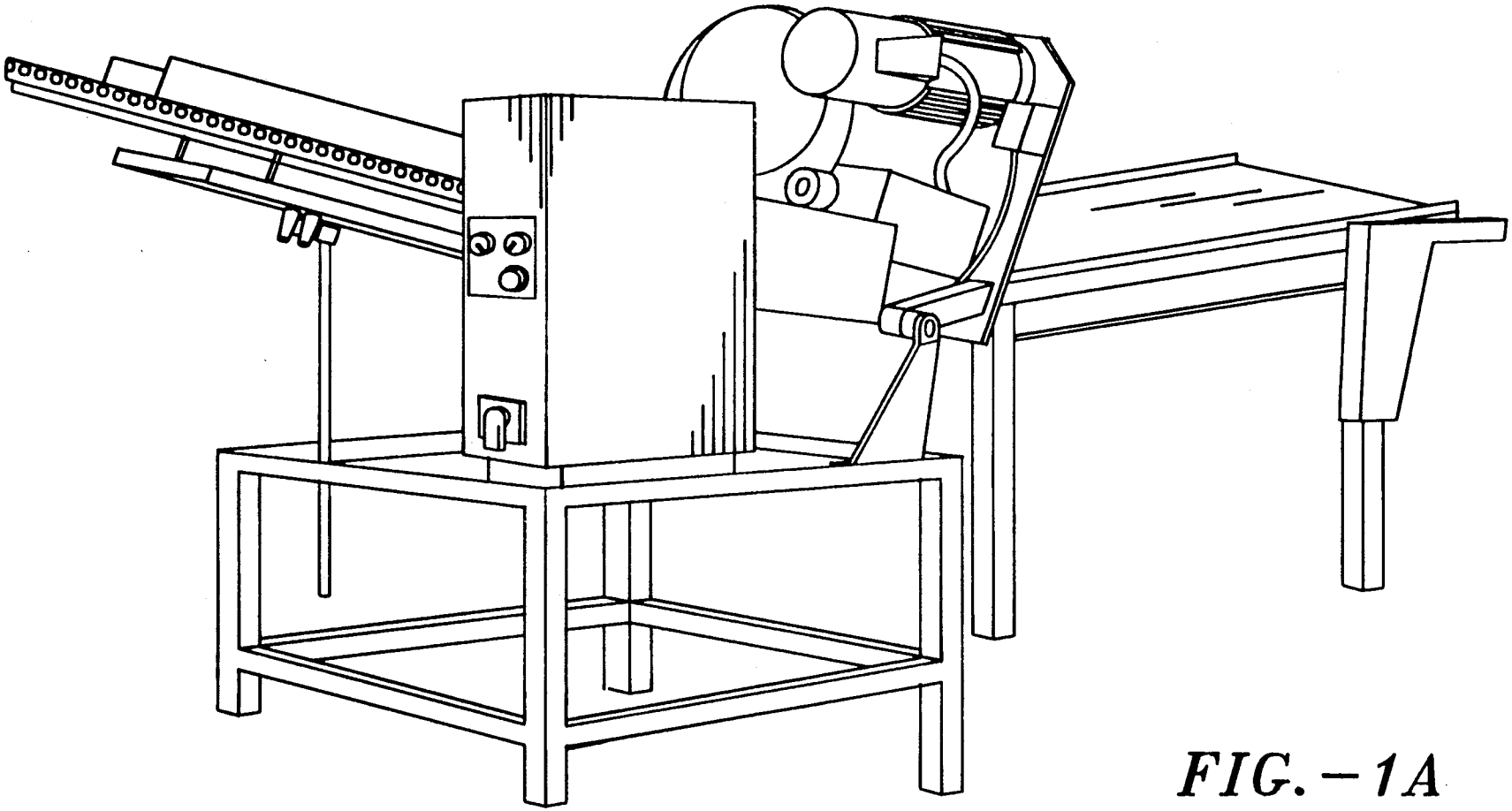
FIG. — 1A PRIOR ART
Figure 1B:
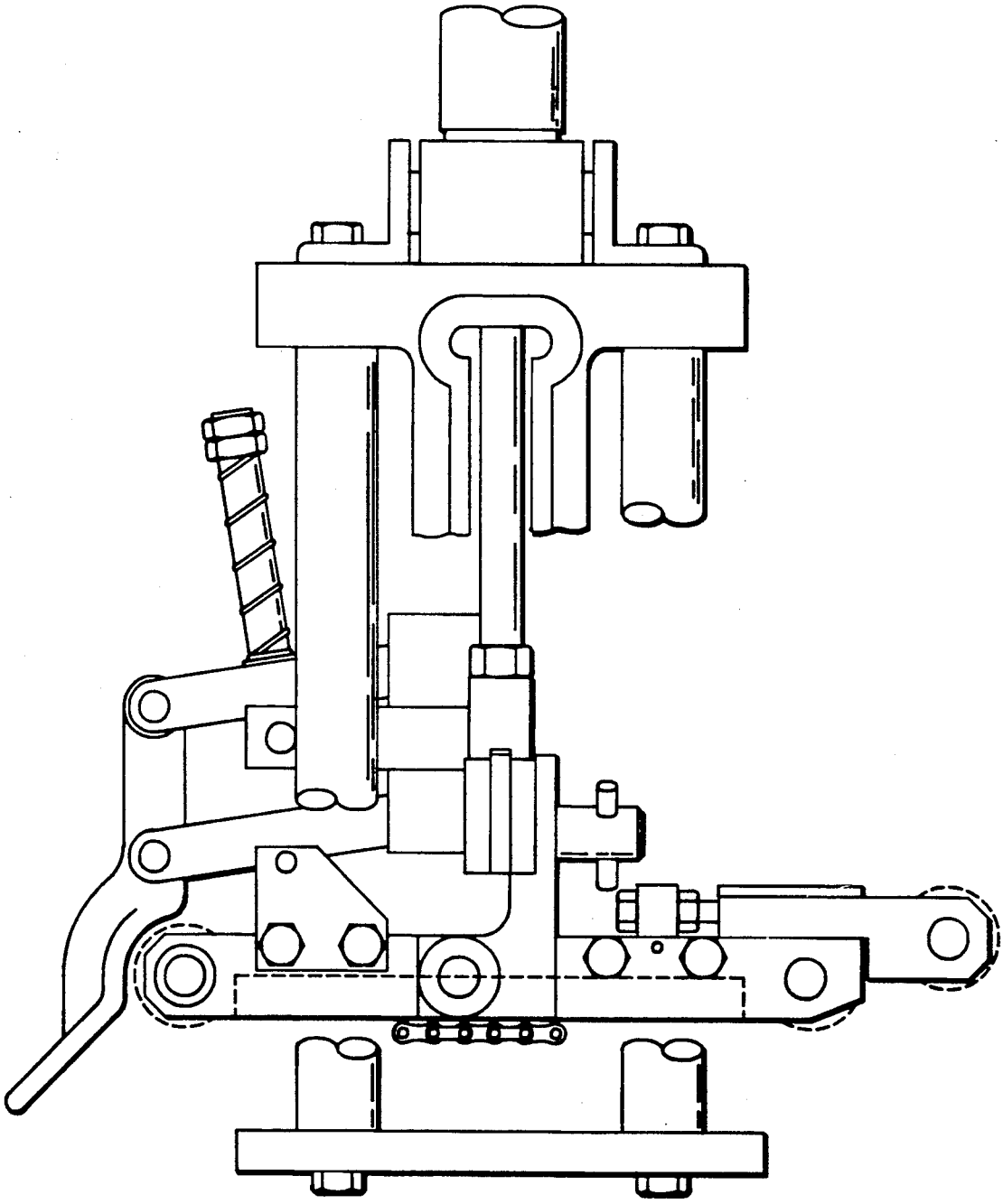
FIG.—1B PRIOR ART

Referring to FIGS. 2a-2d, the feed tray 10 of the present invention can be better appreciated, when taken in conjunction with the slicing machine shown in FIG. 1a. It will be understood by those skilled in the art that the present invention is an enhancement to a conventional slicing machine such as shown in FIG. 1a, and basically replaces most of the feed tray components shown in FIG. 1b. A slicing orifice, indicated generally at 100, is shown mounted to the feed tray 10 of a conventional slicing machine such as either a Toby model 2100 slicer, a Toby model 2600 slicer, or equivalent, from which the operation of the orifice 100 during slicing may be better appreciated.

Figure 2A:
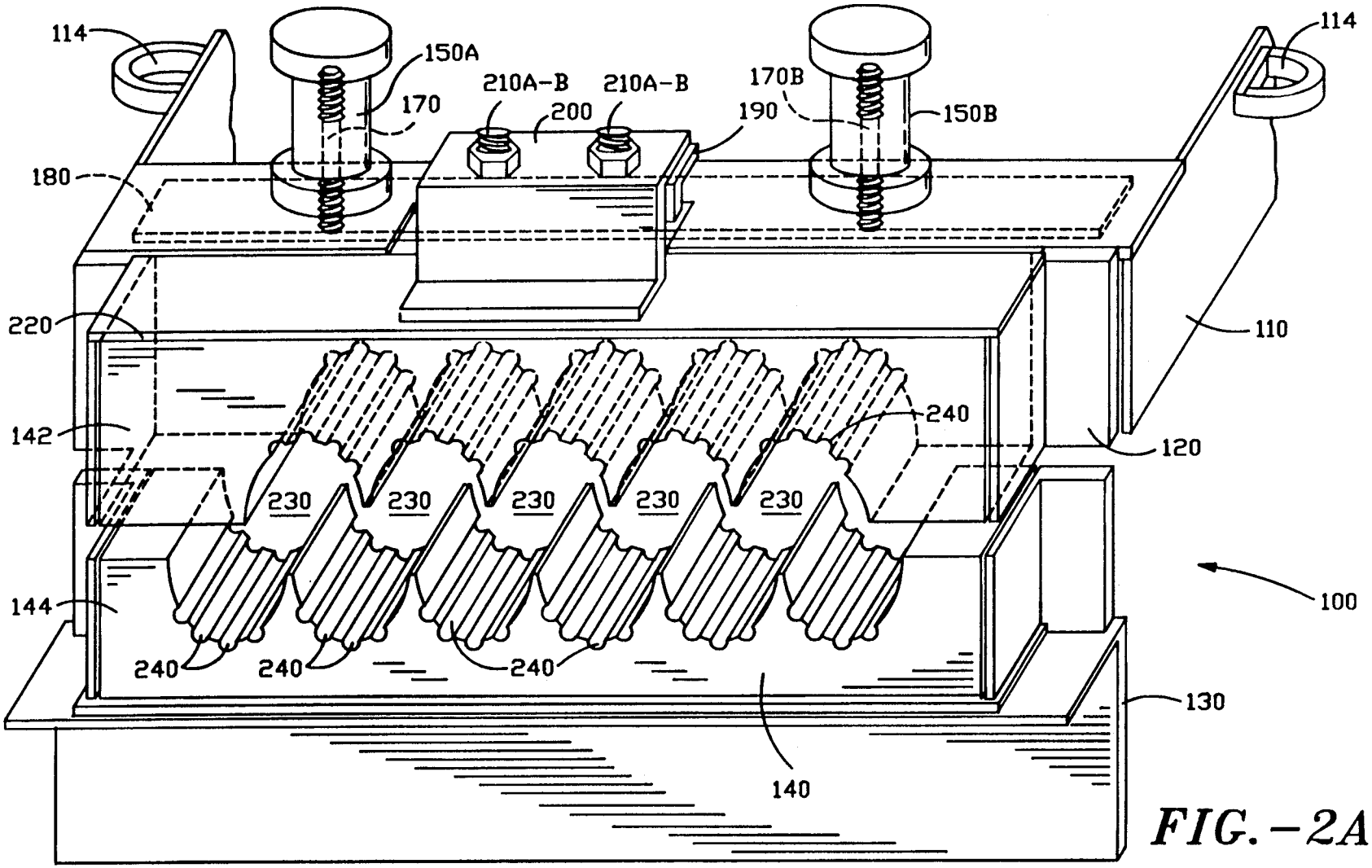
FIG. 2c is a perspective view of a feed tray and slicing orifice in accordance with the present invention, seen from the inlet side of the orifice with the orifice open.
FIG. 2d is a perspective view of a slicing orifice in accordance with the present invention seen from the blade side of the orifice with a plurality of loaves filling all but two of the positions in the orifice.
Figure 2B:
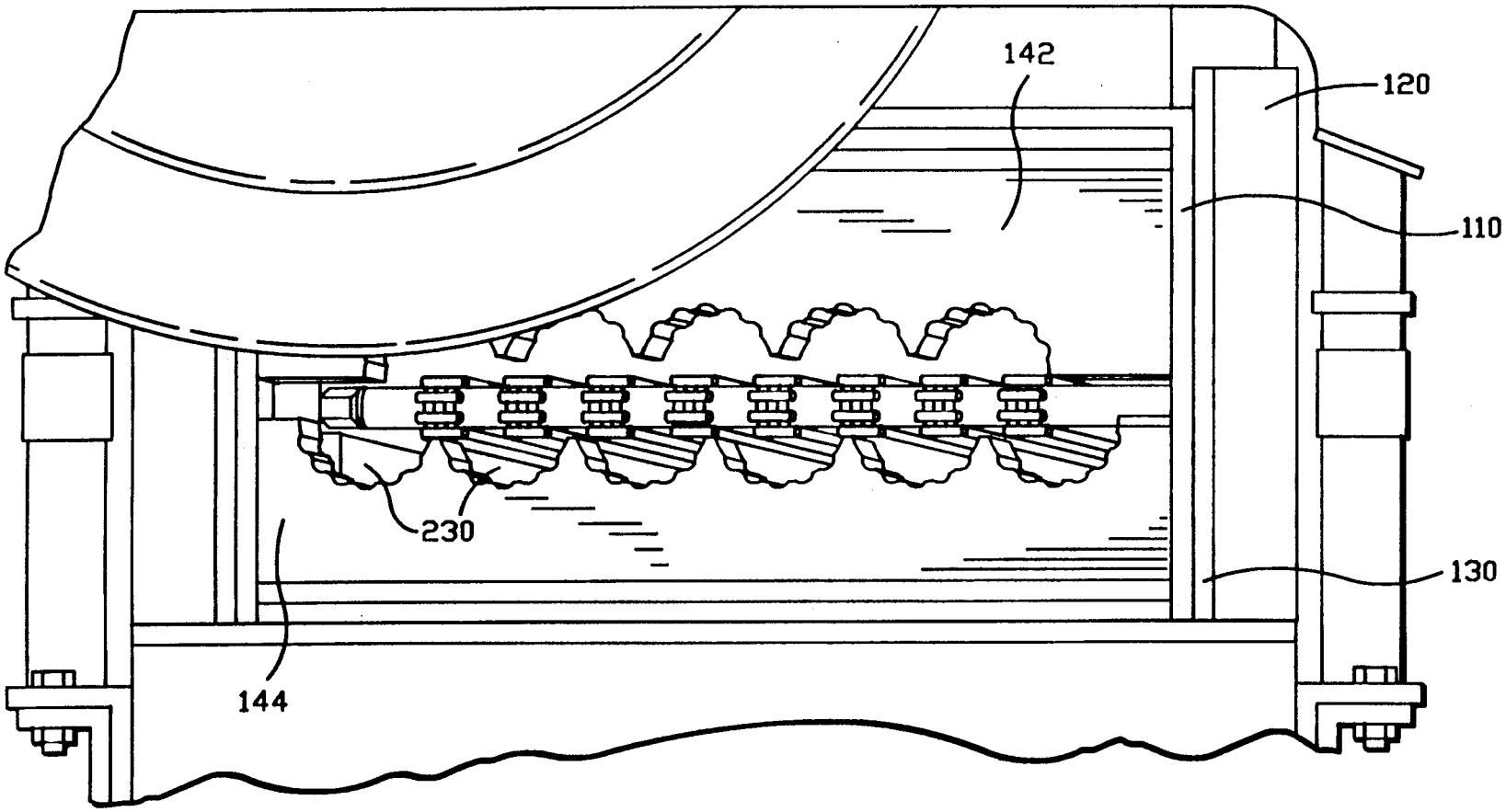
Figure 2C:
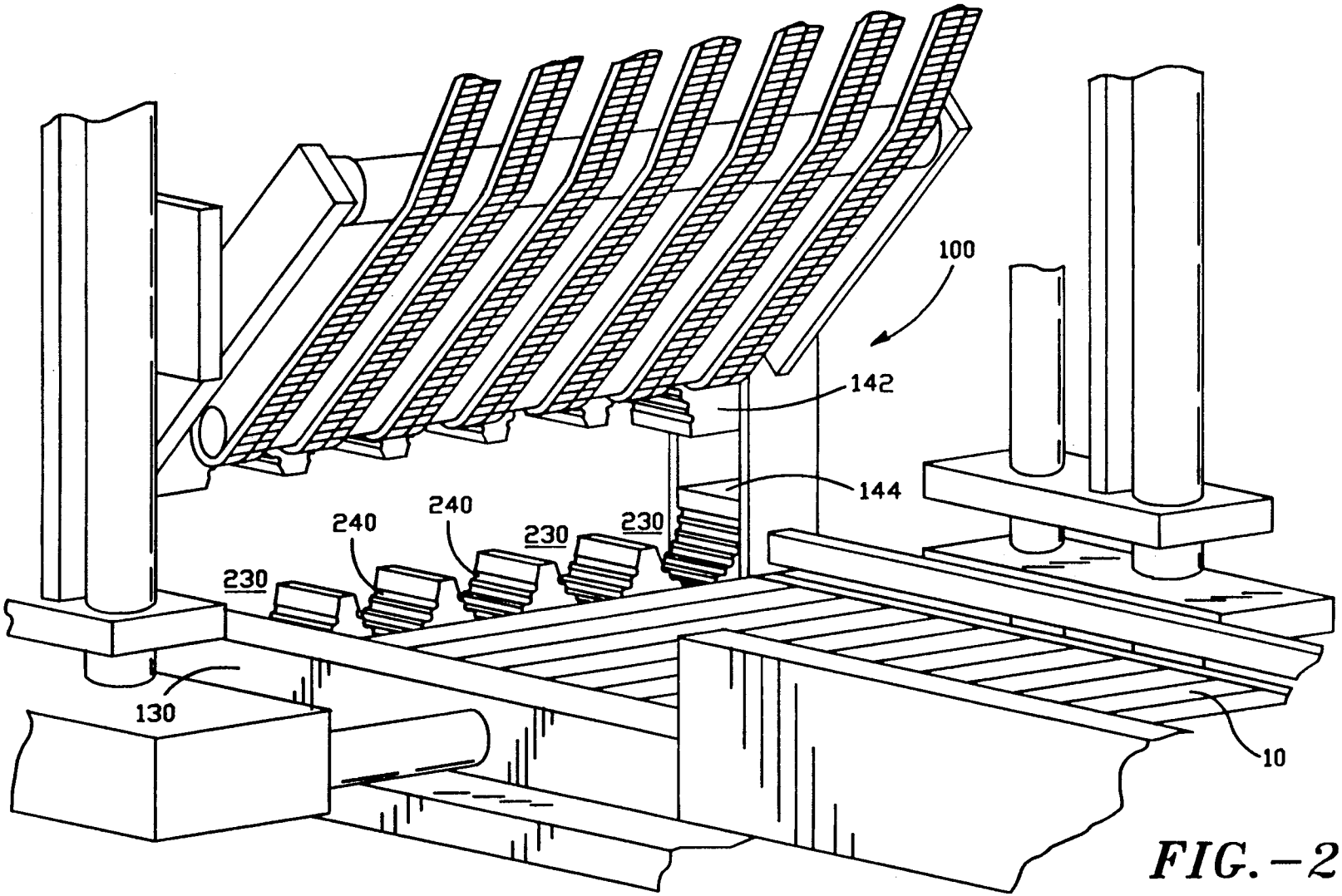
Figure 2D:
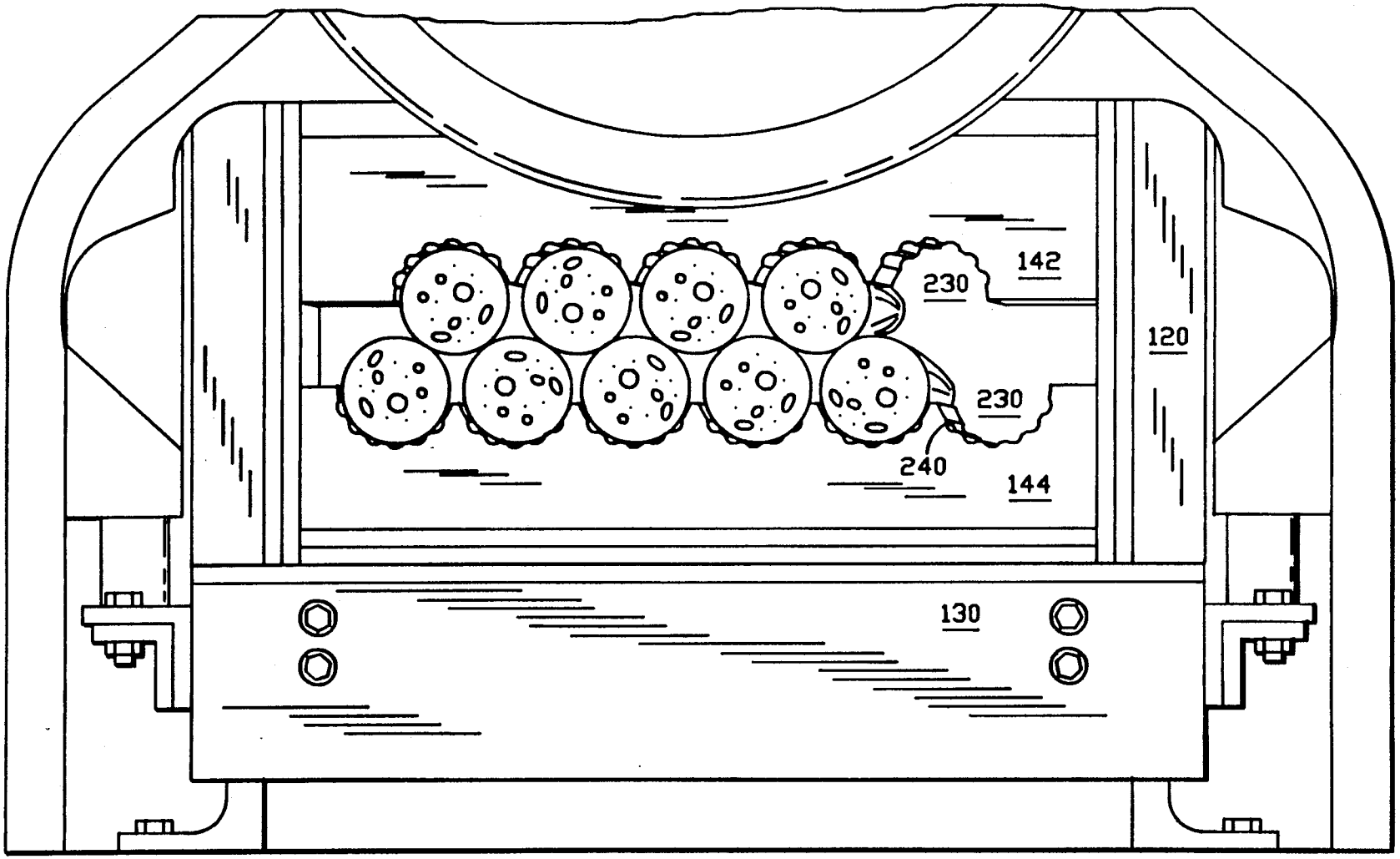

The slicing orifice indicated generally at 100 can be seen to comprise a frame 110 having an upper frame portion 120 and a lower frame portion 130, all as best seen in FIGS. 2a, 2b and 2d. The upper frame portion 120 preferably is fixedly mounted to an otherwise conventional slicing machine 112 at the shaft 114 (FIG. 2a), while the lower frame portion is preferably mounted to a bed 132 of the feed tray 10 (FIGS. 2a, 2c and 2d). The frame 110 preferably is made of stainless steel or other materials appropriate for an environment in which foodstuffs or other materials are to be sliced. The slicing orifice 100 further comprises an insert 140 having an upper half 142 and a lower half 142 (FIGS. 2a to 2d). The insert 140, including its upper and lower halves, is typically made of a polymeric material such as Delrin™ or other material suitable to the environment and the materials to be sliced. The lower half 144 of the insert 140 is fixedly mounted to the lower frame portion 130 by any conventional means.

A pair of pneumatic cylinders 150A-B (FIG. 2a) are fixedly mounted at their housings 160A-B to the upper frame portion 120, while their shafts 170A-B are connected to a plate 180. The cylinders 150a-b are typically dual action air driven cylinders, although single action or other cylinder will also work in at least some instances. Fixedly mounted to the plate 180 is a lower angle bracket 190 which in this exemplary embodiment extends above the upper frame portion 120 and connects to an upper angle bracket 200 by a simple bolting arrangement such as the bolt and nut 210A-B. The upper angle bracket then extends downward to a pressure plate 220 which is connected to the upper half 142 of the insert 140.

The insert 140, including its upper half 142 and lower half 144, may be seen to be contained within the upper and lower frame portions 120 and 130, which permits the upper half 142 of the insert 140 to move vertically in accordance with the motion of the shafts 170A-B.

The upper and lower halves 142 and 144 of the insert 140 may be seen to include a plurality of laterally offset orifices 230 (FIGS. 2a, 2b and 2d). The non-mating nature of the orifices 230 provides improved clamping and is preferable in most instances, although it is also possible to use halves having mating orifices and in some embodiments such an arrangement may be preferable. Each of the orifices 230 is preferably, although not necessarily, chamferred or otherwise enlarged at its entry and bluntly squared at its exit, best seen in FIG. 3. The exit from the orifice 230 may be any shape which provides sufficient rigidity (taking into account the material from which the insert is made) to hold the loaf being sliced firmly in place while permitting the slicing blade to come directly adjacent the last point where the loaf is gripped by the orifice. Typically, the slicing blade for a Toby slicer is maintained at 0.020 to 0.030 inches from the exit side of the slicing orifice, although the range of acceptable distances can vary with application and material being sliced. In operation of a prototype, a squared off exit from the orifices 230 has been found the simplest effective geometry, although beveled or chamferred exit shapes may be acceptable in some instances. In addition, in at least some embodiments it has been found preferable to provide channels 240 in each of the orifices 230. The channels provide, for at least some materials to be sliced, better gripping when clamped and less friction when not clamped.

From the foregoing, the operation of the slicing orifice of the present invention may be seen to be straightforward. The loaf, or loaves, to be sliced are driven by the upper feed chains 30 along the downward sloping bed 132 of the feed tray 10, into the orifices 230 of the insert 140. The pneumatic cylinders 150A-B are actuated, driving the shafts 170 downward. This causes the upper half 142 of the insert 140 to clamp the loaves within the orifices 230, so that the blade of the conventional slicing machine can slice the loaves in the desired manner. Following removal of each slice, the loaf being sliced is indexed forward an appropriate, preselected thickness. During this forward indexing step, the pressure applied by the air cylinders is maintained, thus maintaining substantially improved control of the loaves. Another slice is removed, the loaf again indexed forward, and the process repeated. The improved clamping results in improved control over the loaves, and in turn translates into improved yields.

While the orifices 230 can be seen to behalf circles in the arrangement shown in FIG. 2, it will be appreciated that the shape of the orifices may be altered to conform to the shape of the loaves of material to be sliced. Likewise, the size of the orifices will preferably, although not in all cases necessarily, matched to the size of the loaves being sliced. In addition, while the exemplary embodiment shown here includes five upper and six lower orifices for the sake of simplicity, in practice the number of orifices is not so limited and may include many more orifices, depending on the slicer being used and the materials being sliced.

It can therefore be appreciated that the insert can provide significantly improved positive clamping of even small portions of a loaf, thus permitting reliable slicing of the loaf much closer to its end than has previously been possible. A significant improvement in yield results, providing improved operating economies and reducing waste. In addition, it can further be appreciated that the positive clamping provided by the present invention permits multiple loaves to be stacked vertically and sliced without significantly increased wastage. This again yields a significant yield improvement compared to conventional slicing orifices.

Having fully described a preferred embodiment of the invention, it will be apparent to those skilled in the art, given the teaching herein, that numerous alternatives and equivalents exist which do not depart from the invention. As such, it is to be understood that the foregoing detailed description is exemplary only and not limiting, and that the present invention is to be defined only by the appended claims.

I claim:

1. A slicing orifice for use with a foodstuff slicing machine wherein the foodstuffs have been formed into loaves, bats or sticks and wherein the slicing machine includes at least one feed tray having a bed, at least one feed guide, drive means for indexing the loaves forward, and a cutting head, the improvement comprising an upper clamping portion, a lower clamping portion fixedly mounted to the bed, a plurality of orifices, shaped substantially as a semicircle, in the upper clamping portion and the lower clamping portion, the semicircular orifices in the upper clamping portion being opposed to but laterally offset from the semicircular orifices in the lower clamping portion, each orifice having longitudinal gripping channels formed therein, and actuation means actuably connected to the upper clamping portion and fixedly connected to the feed tray for driving the upper clamping portion toward the lower clamping portion to clamp a foodstuff to be sliced therebetween.

* * * * *